United States Patent [19]

Larson

[11] Patent Number: 4,950,576

[45] Date of Patent: Aug. 21, 1990

[54] CHROMIUM, MOLYBDENUM AND TUNGSTEN COMPOUNDS AS CHARGING ADJUVANTS FOR ELECTROSTATIC LIQUID DEVELOPERS

[75] Inventor: James R. Larson, West Chester, Pa.

[73] Assignee: E. I. DuPont De Nemours and Company, Wilmington, Del.

[21] Appl. No.: 350,026

[22] Filed: May 10, 1989

[51] Int. Cl.[5] ..... G03G 9/12

[52] U.S. Cl. ..... 430/115

[58] Field of Search ..... 430/110, 115

[56] References Cited

U.S. PATENT DOCUMENTS

| | | | |
|---|---|---|---|
| 3,793,015 | 2/1974 | Van Engeland et al. | 430/115 X |
| 3,844,966 | 10/1974 | Nelson | 430/115 |
| 4,024,084 | 5/1977 | Sihardt et al. | 430/115 |
| 4,407,924 | 10/1983 | Senshu et al. | 430/115 X |
| 4,758,494 | 7/1988 | El-Sayed | 430/137 |

FOREIGN PATENT DOCUMENTS

| | | | |
|---|---|---|---|
| 2640963 | 3/1977 | Fed. Rep. of Germany | 430/115 |

*Primary Examiner*—Roland E. Martin

[57] ABSTRACT

An electrostatic liquid developer consisting essentially of (A) a nonpolar liquid having a Kauributanol value of less than 30, present in major amount; (B) thermoplastic resin particles less than 30 μm average particle size; (C) a chromium, molybdenum or tungsten compound having an oxidation state of at least +3 wherein the anionic component is as defined above, and (D) a nonpolar liquid soluble ionic or zwitterionic charge director compound. The process of preparation of the electrostatic liquid developer is also described. The liquid developers are useful in copying, color proofing including digital color proofing, lithographic printing plates, and resists.

32 Claims, No Drawings

CHROMIUM, MOLYBDENUM AND TUNGSTEN COMPOUNDS AS CHARGING ADJUVANTS FOR ELECTROSTATIC LIQUID DEVELOPERS

TECHNICAL FIELD

This invention relates to an electrostatic liquid developer having improved properties. More particularly this invention relates to an electrostatic liquid developer containing resin particles and a compound of chromium, molybdenum, or tungsten.

BACKGROUND ART

It is known that a latent electrostatic image can be developed with toner particles dispersed in an insulating nonpolar liquid. Such dispersed materials are known as liquid toners or liquid developers. A latent electrostatic image may be produced by providing a photo-conductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 30 microns average particle size as measured using the Malvern 3600E Particle Sizer described below or less than 10 μm average particle size by area when determined by Horiba CAPA-500 centrifugal automatic particle analyzer, Horiba Instruments, Inc., Irvine, Calif. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, aminoalcohols, polybutylene succinimide, an aromatic hydrocarbon, metallic soap, etc. to the liquid toner comprising the thermoplastic resin, dispersant nonpolar liquid and preferably a colorant. Such liquid developers provide images of good resolution, but it has been found that charging and image quality are particularly pigment dependent. Some formulations, suffer from poor image quality manifested by low resolution, poor transfer efficiency and poor solid area coverage (density). In order to overcome such problems much research effort has been expended to develop new type charge directors and/or charging adjuvant for electrostatic liquid toners.

It has been found that the above disadvantages can be overcome and developers having improved charging properties, etc. prepared containing a dispersant nonpolar liquid, ionic or zwitterionic charge director compound, a thermoplastic resin, and an adjuvant of the invention. The improved electrostatic liquid developer when used to develop an electrostatic image results in improved image quality, transfer efficiency and improved solid area coverage independent of any pigment and the charge director present.

DISCLOSURE OF THE INVENTION

In accordance with this invention there is provided an electrostatic liquid developer having improved charging characteristics consisting essentially of (A) a nonpolar liquid having a Kauri-butanol value of less than 30, present in a major amount, (B) thermoplastic resin particles, the resin particles having an average particle size of less than 30 μm, (C) a solid inorganic metal compound, wherein the cationic component of said compound is one of the metals of Group 6B of the periodic table having an oxidation state of +3 or higher, and the anionic component of said compound is selected from the group consisting of fluoride, chloride, hydroxide, carbonate, citrate, acetate, oxalate, trifluoroacetate, sulfate, borate, nitrate, phosphate, chloride hydroxide, ethylhexanoate, potassium oxalate, potassium sulfate, and phenoxide, and (D) a nonpolar liquid soluble ionic or zwitterionic charge director compound.

In accordance with an embodiment of this invention there is provided a process for preparing electrostatic liquid developer for electrostatic imaging comprising (A) dispersing at an elevated temperature in a vessel a thermoplastic resin, a solid inorganic metal compound, wherein the cationic component of said compound is one of the metals of Group 6B of the periodic table having an oxidation state of +3 or higher, and the anionic component of said compound is selected from the group consisting of fluoride, chloride, hydroxide, carbonate, citrate, acetate, oxalate, trifluoroacetate, sulfate, borate, nitrate, phosphate, chloride hydroxide, ethylhexanoate, potassium oxalate, potassium sulfate, and phenoxide, a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (B) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(C) separating the dispersion of toner particles having an average particle size of less than 30 μm from the particulate media, and (D) adding to the dispersion a nonpolar liquid soluble ionic or zwitterionic charge director compound.

Throughout the specification the below-listed terms have the following meanings:

In the claims appended hereto "consisting essentially of" means the composition of the electrostatic liquid developer does not exclude unspecified components which do not prevent the advantages of the developer from being realized. For example, in addition to the primary components, there can be present additional components, such as fine particle size oxides, adjuvant, e.g., polyhydroxy compound, aminoalcohol, polybutylene succinimide, metallic soap, aromatic hydrocarbon, etc.

Aminoalcohol means that there is both an amino functionality and hydroxyl functionality in one compound.

Conductivity is the conductivity of the developer measured in picomhos (pmho)/cm at 5 hertz and 5 volts.

The dispersant nonpolar liquids (A) are, preferably, branched-chain aliphatic hydrocarbons and more particularly, Isopar ®-G, Isopar ®-H, Isopar ®-K, Isopar ®-L, Isopar ®-M and Isopar ®-V. These hydrocarbon liquids are narrow cuts of isoparaffinic hydrocarbon fractions with extremely high levels of purity. For example, the boiling range of Isopar ®-G is between 157° C. and 176° C., Isopar ®-H between 176° C. and 191° C., Isopar ®-K between 177° C. and 197° C., Isopar ®-L between 188° C. and 206° C. and Isopar ®-M between 207° C. and 254° C. and Isopar ®-V between 254.4° C. and 329.4° C. Isopar ®-L has a mid-boiling point of approximately 194° C. Isopar ®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including components dispersed therein, e.g., pigment component, adjuvant, etc.

Useful thermoplastic resins or polymers include: ethylene vinyl acetate (EVA) copolymers (Elvax ® resins, E. I. du Pont de Nemours and Company, Wilmington, Del.), copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford, Conn.; ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington, Del., etc., or blends thereof. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 54 and a melt index of 100 and 500 determined at 190° C., respectively.

The thermoplastic resins described above preferably have dispersed therein a solid inorganic metal compound wherein the cationic component of the compound is one of the metals of Group 6B of the periodic table, having an oxidation state of +3 or higher, i.e., chromium, molybdenum or tungsten, and wherein the anionic component of the compound is selected from the group consisting of fluoride, chloride, hydroxide, carbonate, citrate, acetate, oxalate, trifluoroacetate, sulfate, borate, nitrate, phosphate, chloride hydroxide, ethylhexanoate, potassium oxalate, potassium sulfate, and phenoxide. As shown in Controls 5A and 5B below, the iodide and bromide compounds are found to give unsatisfactory results. $WF_6$ is excluded because it is a gas at ambient conditions.

The inorganic metal compound is present in 0.1 to 40 percent by weight of toner solids, preferably 1 to 10 percent by weight based on the total weight of the developer solids. The method whereby the inorganic metal compound is dispersed in the thermoplastic resin is described below. The inorganic metal compounds may also be added later in the process of preparation of the toners, e.g., along with the charge director. In this embodiment the compounds are present in the liquid phase of the developer.

Suitable inorganic metal compounds include: Cr(III) acetate, Cr(III) acetate hydroxide, CR(III) borate, Cr(III) carbonate, Cr(III), chloride, Cr(III) chloride hydroxide, Cr(III) citrate, Cr(III) 2-ethylhexanoate, Cr(III) fluoride, Cr(III) hydroxide, Cr(III) nitrate, Cr(III) oxalate, Cr(III) phosphate, Cr(III) potassium oxalate, Cr(III) potassium sulfate, Cr(III) sodium sulfate, Cr(III) trifluoroacetate, Mo(III) chloride, Mo(IV) chloride, Mo(IV) dihydroxide dichloride, Mo(V) chloride, W(IV) chloride, W(V) chloride, W(VI) chloride, W(VI) phenoxide, etc.

In addition, the resins have the following preferred characteristics:

1. Be able to disperse the adjuvant, colorant, e.g., pigment.

2. Be substantially insoluble in the dispersant liquid at temperatures below 40° C., so that the resin will not dissolve or solvate in storage.

3. Be able to solvate at temperatures above 50° C.

4. Be able to be ground to form particles between 0.1 μm and 15 μm, in diameter.

5. Be able to form a particle of less than 30 μm average particle size, e.g., determined by Malvern 3600E Particle Sizer, manufactured by Malvern, Southborough, Mass. The Malvern 3600E Particle Sizer uses laser diffraction light scattering of stirred samples to determine average particle sizes.

6. Be able to fuse at temperatures in excess of 70° C. By solvation in 3. above, the resins forming the toner particles will become swollen, gelatinous or softened.

Suitable nonpolar liquid soluble ionic or zwitterionic charge director compounds (C), which are generally used in an amount of 0.25 to 1500 mg/g, preferably 2.5 to 400 mg/g developer solids, include: lecithin, Basic Calcium Petronate®, Basic Barium Petronate® oil-soluble petroleum sulfonate, manufactured by Sonneborn Division of Witco Chemical Corp., New York, N.Y., alkyl succinimide manufactured by Chevron Chemical Company of California, etc.; Emphos ®D70-30C and Emphos ®F-27-85, sodium salts of phosphated mono-diglycerides with unsaturated and saturated acid substituents respectively, etc. manufactured by Witco Chemical Corp., supra; etc.

As indicated above, colorants may be dispersed in the resin. Colorants, such as pigments or dyes and combinations thereof, are preferably present to render the latent image visible. The colorant, e.g., a pigment, may be present in the amount of up to about 60 percent by weight based on the total weight of developer solids, preferably 0.01 to 30% by weight based on the total weight of developer solids. The amount of colarant may vary depending on the use of the developer. Examples of pigments include:

Pigment List

| Pigment Brand Name | Manufacturer | Colour Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| Cromophtal ® Yellow 3G | Ciba-Geigy | Yellow 93 |
| Cromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophtal ® Yellow 8G | Ciba-Geigy | Yellow 128 |
| Irgazine ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | Yellow 14 |
| L75-1331 Yellow | Sun Chem. | Yellow 17 |
| L75-2337 Yellow | Sun Chem. | Yellow 83 |

-continued

Pigment List

| Pigment Brand Name | Manufacturer | Colour Index Pigment |
|---|---|---|
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | Blue:3 |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | Violet 19 |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |
| Mogul L | Cabot | Black, CI 77266 |
| Uhlich ® BK 8200 | Paul Uhlich | Black (Blackness Index 155) |

Other ingredients may be added to the electrostatic liquid developer, such as fine particle size oxides, e.g., silica, alumina, titania, etc.; preferably in the order of 0.5 μm or less can be dispersed into the liquefied resin. These oxides can be used instead of the colorant or in combination with the colorant. Metal particles can also be added.

Another additional component of the electrostatic liquid developer is an adjuvant which can be selected from the group consisting of polyhydroxy compound which contains at least 2 hydroxy groups, aminoalcohol, polybutylene succinimide, metallic soap, and aromatic hydrocarbon having a Kauri-butanol value of greater than 30. The adjuvants are generally used in an amount of 1 to 1000 mg/g, preferably 1 to 200 mg/g developer solids. Examples of the various above-described adjuvants include polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxystearate, etc. as described in Mitchell U.S. Pat. No. 4,734,352.

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc. as described in Larson U.S. Pat. No. 4,702,985.

polybutylene/succinimide: OLOA ®-1200 sold by Chevron Corp., analysis information appears in Kosel U.S. Pat. No. 3,900,412, column 20, lines 5 to 13, the disclosure of which is incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.

These adjuvants are described in El-Sayed and Taggi U.S. Pat. No. 4,702,984.

metallic soap: aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium cobalt, manganese, lead and zinc naphthenates; calcium, cobalt, manganese, lead and zinc resinates; etc. The metallic soap is dispersed in the thermoplastic resin as described in Trout U.S. Pat. Nos. 4,707,429 and 4,740,444.

aromatic hydrocarbon: benzene, toluene, naphthalene, substituted benzene and naphthalene compounds, e.g., trimethylbenzene, xylene, ethylbenzene, ethylmethylbenzene, dimethyl ethylbenzene, and $C_{10}$ alkyl-substituted benzenes manufactured by Exxon Corp., etc. as described in Mitchell U.S. Pat. No. 4,631,244.

The disclosures of the above-listed United States patents describing the adjuvants are incorporated herein by reference.

The particles in the electrostatic liquid developer have an average particle size of less than 30 μm as measured by Malvern 3600E Particle Sizer described above, preferably the average particle size is less than 15 μm. The resin particles of the developer having the metallic soap dispersed therein may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two roll heated mill (no particulate media necessary) are placed at least one of thermoplastic resin, inorganic metal compound, and dispersant polar liquid described above. Generally the resin, optional colorant, said metal compound, and dispersant nonpolar liquid are placed in the vessel prior to starting the dispersing step. It has been found that the said metal compound may be added subsequently, e.g., in conjunction with the charge director compound or subsequent thereto. Optionally the colorant can be added after homogenizing the resin and the dispersant nonpolar liquid. Polar liquid can also be present in the vessel, e.g., up to 100% based on the weight of total developer liquid. The dispersing step is generally accomplished at elevated temperature, i.e., the temperature of ingredients in the vessel being sufficient to plasticize and liquefy the resin but being below that at which the dispersant nonpolar liquid or polar liquid, if present, degrades and the resin and/or colorant, if present, decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc., selected from the group consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar liquid present until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding with or without the presence of additional liquid with particulate media to prevent the formation of a gel or solid mass; without stirring to form a gel or solid mass, followed by shredding the gel or solid mass and grinding, e.g., by means of particulate media with or without the presence of additional liquid; or with stirring to form a viscous mixture and grinding by means of particulate media with or without the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size of less than 30 μm, as determined by a Malvern 3600E Particle Sizer described above, are formed by grinding for a relatively short period of time. Throughout the specification and claims the average particle size is determined by the Malvern Instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion may be reduced by the addition of additional dispersant nonpolar liquid as described previously above. The dilution is normally conducted to reduce the concentration of toner particles to between 0.1 to 15 percent by weight, preferably 0.3 to 3.0, and more preferably 0.5 to 2 weight percent with respect to the dispersant nonpolar liquid. One or more nonpolar liquid soluble ionic or zwitterionic charge director compounds (C), of the type set out above, can be added to impart a positive or negative charge, as desired. The addition may occur at any time during the process; preferably at the end of the process, e.g., after the particulate media, if used, are removed and the reduction of concentration of toner particles is accomplished. If a diluting dispersant nonpolar liquid is also added, the ionic or zwitterionic compound can be added prior to, concurrently with, or subsequent thereto. If an adjuvant compound of a type described above has not been previously added in the preparation of the developer, it can be added prior to or subsequent to the developer being charged.

Other process embodiments for preparing the electrostatic liquid developer include:

(A) dispersing a colorant and an inorganic metal compound as described herein in a thermoplastic resin in the absence of a dispersant nonpolar liquid having a Kauributanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average particle size of less than 30 μm from the particulate media, and (E) adding additional nonpolar liquid, polar liquid or combinations thereof to reduce the concentration of toner particles to between 0.1 to 15 percent by weight with respect to the liquid; and (F) adding to the dispersion a liquid soluble ionic or zwitterionic charge director compound; and (A) dispersing a colorant and an inorganic metal compound as described herein in a thermoplastic resin in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average particle size of less than 30 μm from the particulate media, (F) adding additional nonpolar liquid, polar liquid, or combinations thereof to reduce the concentration of toner particles to between 0.1 to 15 percent by weight with respect to the developer liquid; and (G) adding to the dispersion a liquid soluble ionic or zwitterionic charge director compound.

Preferred modes of the invention are described in Examples 2 and 3.

INDUSTRIAL APPLICABILITY

The electrostatic liquid developers of this invention demonstrate improved image quality, resolution, solid area coverage (density), and toning of fine details, evenness of toning, and reduced squash independent of charge director and pigment present. The developers of this invention are useful in copying, e.g., making office copies of black and white as well as various colors; or color proofing, e.g., a reproduction of an image using the standard colors: yellow, cyan, magenta together with black as desired. In copying and proofing the toner particles are applied to a latent electrostatic image. Other uses are envisioned for the electrostatic liquid developers include: digital color proofing, lithographic printing plates, and resists.

EXAMPLES

The following controls and examples wherein the parts and percentages are by weight illustrate but do not limit the invention. In the examples the melt indices were determined by ASTM D 1238, Procedure A, the average particle sizes were determined by a Malvern 3600E Particle Sizer, manufactured by Malvern, Southborough, Mass. as described above, the conductivity was measured in picomhos (pmho)/cm at 5 hertz and low voltage, 5 volts, and the density was measured using a Macbeth densitometer model RD918. The resolution is expressed in the Examples in line pairs/mm (lp/mm). Aldrich Chemical Co., Milwaukee, Wis. is designated Aldrich in the Examples and Controls below.

CONTROL 1

The following ingredients were placed in a Union Process 01 Attritor, Union Process Company, Akron, Ohio:

| Ingredient | Amount (g) |
|---|---|
| Copolymer of ethylene (91%) and methacrylic acid (9%) melt index at 190° C. is 500, Acid No. is 54. | 25 |
| Heucophthal Blue G XBT-583D Heubach, Inc., Newark, NJ | 2.7 |
| Isopar ®-L, nonpolar liquid having a Kauri-butanol value of 27, Exxon Corporation | 140 |

The ingredients were heated to 100° C.±10° C. in the attritor and milled with 0.1875 inch (4.76 mm) diameter carbon steel balls for one hour. The attritor was cooled to room temperature while the milling was continued for 3 hours to obtain toner particles with an average size of 6.9 μm. The particulate media were removed and the dispersion of toner particles was then diluted to 1.5% solids with additional Isopar ®-L. To 1500 grams of the dispersion were added 11.2 grams of Basic Barium Petronate ® (Witco Chemical Corporation, New York, N.Y.) in Isopar ®-L. Image quality was determined using a Savin 870 copier at standard mode: charging corona set at 6.8 Kv and transfer corona set at 8.0 Kv using carrier sheets such as Plainwell offset enamel paper number 3 class a 60 lb. test, and Savin 2200 paper. The results are shown in Table 1 below.

CONTROL 2

The toner was prepared as described in Control 1 except that 0.507 g chromium chloride (Aldrich) was added with the resin and pigment. Particle size was 7.1 μm. Results are found in Table 1 below.

CONTROL 3

The following ingredients were placed in a Union Process IS Attritor, Union Process Company, Akron, Ohio:

| Ingredient | Amount (g) |
|---|---|
| Copolymer of ethylene (91%) and methacrylic acid (9%) melt index at 190° C. is 500, Acid No. is 54. | 75 |
| Mobay R6700 pigment, manufactured by Mobay Chemical | 8.1 |

-continued

| Ingredient | Amount (g) |
|---|---|
| Corp., Haledon, NJ | |
| Isopar ®-L, nonpolar liquid having a 420 Kauri-butanol value of 27, Exxon Corporation | 420 |

The ingredients were heated to 100° C.±10° C. in the attritor and milled at a rotor speed of 230 r.p.m. with 0.1875 inch (4.76 mm) diameter carbon steel balls for one hour. The attritor was cooled to room temperature while the milling was continued at a rotor speed of 330 r.p.m. for 5 hours to obtain toner particles with an average size of 6.9 μm. The particulate media were removed and the dispersion of toner particles was then diluted to 1.5 percent solids with additional Isopar ®-L. To 1500 grams of the dispersion were added 11.2 grams of Basic Barium Petronate ® (Witco Chemical Corp.) in Isopar ®-L. Image quality was determined using a Savin 870 copier at standard mode and carrier sheets as described in Control 1. The results are shown in Table 1 below.

CONTROL 4

The following ingredients were placed in a Union Process 01 Attritor, Union Process Company, Akron, Ohio:

| Ingredient | Amount (g) |
|---|---|
| Copolymer of ethylene (91%) and methacrylic acid (9%) melt index at 190° C. is 500, Acid No. is 54. | 25 |
| Mobay R6700 pigment, manufactured by Mobay Chemical Corp., Haledon, NJ | 2.7 |
| $CrCl_2$ (Aldrich, 90%) | 0.507 |
| Isopar ®-L, nonpolar liquid having a Kauri-butanol value of 27, Exxon Corporation | 140 |

The ingredients were heated to 100° C.±10° C. in the attritor and milled with 0.1875 inch (4.76 mm) diameter carbon steel balls for one hour. The attritor was cooled to room temperature while the milling was continued for 3 hours to obtain toner particles with an average size of 7.4 μm. The particulate media were removed and the dispersion of toner particles was then diluted to 1.5 percent solids with additional Isopar ®-L. To 1600 grams of the dispersion were added 12 grams of Basic Barium Petronate ® (Witco Chemical Corp Image quality was determined using a Savin 870 copier at standard mode and carrier sheets as described in Control 1. The results are shown in Table 1 below.

EXAMPLE 1

The toner was prepared as described in Control 1 except that 1.27 g of tungsten hexachloride (Aldrich) were added with the resin and pigment. Particle size was 5.7 μm after 21 hours of cold grind. Results are found in Table 1 below.

EXAMPLE 2

The toner was prepared and tested as described in Control 4 except that 0.507 g of $CrCL_3$ (Aldrich) was added instead of $CrCl_2$. Particle size was 6.3 μm after 4.5 hours of cold grind. Results are found in Table 1 below.

TABLE 1

| TONER | ADDITIVE | COND. (pmho/cm) | PAPER | DENSITY | RESOLUTION (lp/mm) | TRANSFER EFFICIENCY (%) |
|---|---|---|---|---|---|---|
| CONTROL 1 | NONE | 22 | SAVIN | 0.7 | 8 | 77 |
| | | | OFFSET | 0.7 | 7 | 86 |
| CONTROL 2 | $CrCl_2$ | 41 | SAVIN | 0.1 | 1 | 35 |
| | | | OFFSET | 0.1 | 1 | 41 |
| CONTROL 3 | NONE | 13 | SAVIN | 1.1 | 6 | 61 |
| | | | OFFSET | 1.4 | 6 | 91 |
| CONTROL 4 | $CrCl_2$ | 38 | SAVIN | 0.3 | 1 | 40 |
| | | | OFFSET | 0.4 | 3 | 35 |
| EXAMPLE 1 | $WCl_6$ | 25 | SAVIN | 0.4 | 12 | 81 |
| | | | OFFSET | 0.6 | 14 | 84 |
| EXAMPLE 2 | $CrCl_3$ | 15 | SAVIN | 0.9 | 8 | 84 |
| | | | OFFSET | 1.4 | 10 | 89 |

CONTROL 5

The following ingredients were placed in a Union Process 1S Attritor, Union Process Company, Akron, Ohio:

| Ingredient | Amount (g) |
|---|---|
| Copolymer of ethylene (91%) and methacrylic acid (9%) melt index at 190° C. is 500, Acid No. is 54. | 225 |
| Mobay R6700 pigment, manufactured by Mobay Chemical Corp., Haledon, NJ | 75 |
| Isopar ®-L, nonpolar liquid having a Kauri-butanol value of 27, Exxon Corporation | 609 |

The ingredients were heated to 100° C.±10° C. in the attritor and milled at a rotor speed of 230 r.p.m. with 0.1875 inch (4.76 mm) diameter carbon steel balls for one hour. The attritor was cooled to room temperature while the milling was continued for 2 hours to obtain toner particles with an average size of 6.3 μm. The particulate media were removed and the dispersion of toner particles was then diluted to 1.5 percent solids with additional Isopar ®-L. To 2500 grams of the dispersion were added 18.75 grams of 10% Basic Barium Petronate ® (Witco Chemical Corp.) in Isopar ®-L. Image quality was determined using a Savin 870 copier at standard mode and carrier sheets as described in Control 1. The results are shown in Table 2 below.

CONTROL 5A

The following ingredients were placed in a Union Process 01 Attritor, Union Process Company, Akron, Ohio:

| Ingredient | Amount (g) |
|---|---|
| Copolymer of ethylene (91%) and methacrylic acid (9%) melt index at 190° C. is 500, Acid No. is 54. | 24.75 |
| Mobay R6700 pigment, manufactured by Mobay Chemical Corp., Haledon, NJ | 7.27 |
| $CrI_2$ Alfa Chemical Co., Danvers, MA (Alfa) anhydrous 99%) | 0.98 |
| Isopar ®-L, nonpolar liquid having a Kauri-butanol value of 27, Exxon Corporation | 77 |

The ingredients were heated to 100° C.±b 10° C. in the attritor and milled with 0.1875 inch (4.76 mm) diameter stainless steel balls for one hour. The attritor was cooled to room temperature while the milling was continued for 3.5 hours to obtain toner particles with an average size of 6.4 μm. The particulate media were removed and the dispersion of toner particles was then diluted to 1.5 percent solids with additional Isopar ®L. To 2500 grams of the dispersion were added 18.75 grams of 10% Basic Barium Petronate ® (Witco Chemical Corp.) in Isopar ®-L. Image quality was determined using a Savin 870 copier at standard mode and carrier sheets as described in Control 1. The results are shown in Table 2 below.

CONTROL 5B

A magenta toner was prepared as described in Control 5A with the following exceptions: the ingredients were cold ground for 2 hours following the hot milling step resulting in toner particles with an average size of 6.7 μm, 6.8 grams of Mobay R6700 pigment were used and 1.4 grams of $WI_2$ (Alfa, 99%) were added instead of $CrI_2$. Results are shown in Table 2 below.

EXAMPLE 3

A magenta toner was prepared as described in Control 5A with the following exceptions: the ingredients were cold ground for 4 hours following the hot milling step resulting in toner particles having an average size of 6.4 μm, 7.7 grams of Mobay R6700 pigment were used, and 0.55 gram of $CrF_3.3.5\ H_2O$ (Alfa) was added instead of $CrI_2$. Results are shown in Table 2 below.

EXAMPLE 4

A magenta toner was prepared as described in Control 5A with the following exceptions: the ingredients were cold ground for 2.5 hours following the hot milling step resulting in toner particles having an average particle size of 5.0 μm, 7.55 grams of Mobay R6700 pigment were used, and 0.7 gram of $CrPO_4.4H_2O$ (Alfa) was added instead of $CrI_2$. Results are shown in Table 2 below.

TABLE 2

| TONER | ADDITIVE | COND. (pmho/cm) | PAPER | DENSITY | RESOLUTION (lp/mm) | TRANSFER EFFICIENCY (%) |
|---|---|---|---|---|---|---|
| CONTROL 5 | NONE | 20 | SAVIN | 1.10 | 9 | 87 |
| | | | OFFSET | 1.75 | 10 | 97 |
| CONTROL 5A | $CrI_2$ | 6 | | VERY POOR IMAGE | | |
| CONTROL 5B | $WI_2$ | 13 | | NO IMAGE AT ALL | | |
| EXAMPLE 3 | $CrF_3$ | 18 | SAVIN | 1.37 | 9 | 92 |
| | | | OFFSET | 2.10 | 10 | 99 |
| EXAMPLE 4 | $CrPO_4$ | 23 | SAVIN | 1.22 | 10 | 95 |
| | | | OFFSET | 1.93 | 11 | 99 |

CONTROL 6

The following ingredients were placed in a Union Process 1S Attritor, Union Process Company, Akron, Ohio:

| Ingredient | Amount (g) |
|---|---|
| Copolymer of ethylene (91%) and methacrylic acid (9%) melt index at 190° C. is 500, Acid No. is 54. | 300 |
| Heucophthal Blue G XBT-583D Heubach, Inc., Newark, NJ | 32 |
| Isopar ®-L, nonpolar liquid having a Kauri-butanol value of 27, Exxon Corporation | 776 |

The ingredients were heated to 100° C.±10° C. in the attritor and milled at a rotor speed of 230 r.p.m. with 0.1875 inch (4.76 mm) diameter carbon steel balls for 1.0 hour. The attritor was cooled to room temperature while the milling was continued for 2 hours to obtain toner particles with an average size of 9.0 μm. The particulate media were removed and the dispersion of toner particles was then diluted to 1.0 percent solids with additional Isopar ®-L. To 500 grams of the dispersion were added 7.5 grams of 10% Basic Barium Petronate ® (Witco Chemical Corp.) in Isopar ®-L. Image quality was determined using a Savin 870 copier at standard mode and carrier sheets as described in Control 1. The results are shown in Table 3 below.

EXAMPLE 5

Five cyan toners were prepared as described in Control 6 with the following exceptions: 0.5 gram of the five metal compounds identified in Table 3 were added. Results are found in Table 3 below. The uniformity of the solid areas on offset paper was much better for the Example 5 toners than for the Control 6 toner.

TABLE 3

| TONER | ADDITIVE | COND. (pmho/cm) | PAPER | DEN-SITY | RESOLU-TION (lp/mm) |
|---|---|---|---|---|---|
| CONTROL 6 | NONE | 15 | OFFSET | 2.05 | 6 |
| EXAMPLE 5A | $CrK(SO_4)_2$[1] | 18 | OFFSET | 2.16 | 9 |
| EXAMPLE 5B | $MoCl_3$[2] | 16 | OFFSET | 2.10 | 8 |
| EXAMPLE 5C | $CrPO_4$[3] | 17 | OFFSET | 2.10 | 10 |
| EXAMPLE 5D | $CrCl_3$[4] | 16 | OFFSET | 2.02 | 8 |
| EXAMPLE 5E | $CrF_3$[5] | 17 | OFFSET | 2.10 | 9 |

[1]$CrK(SO_4)_2$ is $CrK(SO_4)_2.12H_2O$ (Aldrich)
[2]$MoCl_3$ is $MoCl_3$ (Alfa)
[3]$CrPO_4$ is $CrPO_4.4H_2O$ (Alfa)
[4]$CrCl_3$ is $CrCl_3$ (Aldrich)
[5]$CrF_3$ is $CrF_3.5H_2O$ (Aldrich)

CONTROL 7

The following ingredients were placed in a Union Process 1S Attritor, Union Process Company, Akron, Ohio:

| Ingredient | Amount (g) |
|---|---|
| Copolymer of ethylene (91%) and methacrylic acid (9%) melt index at 190° C. is 500, Acid No. is 54. | 308 |
| Uhlich ® BK8200 carbon black pigment | 196 |
| p-toluene sulfonic acid | 10.6 |
| Isopar ®-L, nonpolar liquid Kauri-butanol value of 27, Exxon Corporation | 1700 |

The ingredients were heated to 100° C.±10° C. in the attritor and milled at a rotor speed of 230 r.p.m. with 0.1875 inch (4.76 mm) diameter carbon steel balls for 1 hour. The attritor was cooled to room temperature while the milling was continued for 2 hours to obtain toner particles with an average size of 7.8 μm. The particulate media were removed and the dispersion of toner particles was then diluted to 1.0 percent solids with additional Isopar ®-L. To 1500 grams of the dispersion were added 15 grams of 5% Emphos ®D70-30C sodium glyceryl oleate phosphate, Witco Chemical Corp., New York, N.Y. in Isopar ®-L. Image quality was determined using a Savin 870 copier under positive toner test conditions: charging corona set at +6.8 Kv, development bias set at +650 volts, transfer corona set at −6.6 Kv and a reversed image target, i.e., black areas on target image are toned with negative toner, white areas with positive toner and the grey areas are background. Plainwell offset enamel paper described in Control 1 was used. The results are shown in Table 4 below.

EXAMPLE 6

A black toner was prepared and charged as described in Control 7 with the following exception: 1 gram of $CrPO_4.4H_2$(Alfa) was added. The uniformity of solid areas on the offset paper was much better for this toner than for that of Control 7.

TABLE 4

| TONER | $CrPO_4.4H_2O$ (g) | COND. (pmho/mm) | PAPER | DENSITY | RES. (lp/mm) | TRANS-FER EFFI-CIENCY |
|---|---|---|---|---|---|---|
| CONTROL 7 | NONE | 8 | OFFSET | 0.4 | 8 | POOR |
| EXAMPLE 6 | 1.0 | 8 | OFFSET | 0.4 | 10 | POOR |

CONTROL 8

The following ingredients were placed in a Union Process 1S Attritor, Union Process Company, Akron, Ohio:

| Ingredient | Amount (g) |
|---|---|
| Polystyrene (Aldrich, catalog 18242-7, 1988–89 Molecular weight is 250,000, density 1.047, Tg 100° C., temp. melting 237.5° C., ref. index $n_d^{20}$ = 1.5916 | 394 |
| N-774 Sterling NS carbon black pigment, Cabot Corp. | 99.8 |
| Aluminum stearate, Nuodex Corp. | 5 |
| Aromatic ® 150, a high purity aromatic solvent having a Kauri-butanol value of 95, Exxon Corp. | 1167 |

The ingredients were heated to 100° C.±10° C. in the attritor and milled at a rotor speed of 230 r.p.m. with 0.1875 inch (4.76 mm) diameter carbon steel balls for 1 hour. The attritor was cooled to 30° C. while the milling was continued for 4 hours to obtain toner particles with an average size of 2.1 μm. The particulate media were removed and the dispersion of toner particles was then diluted to 1.5 percent solids with Isopar ®-L. To 1500 grams of the dispersion were added 11.2 grams of 10% Basic Barium Petronate ® (Witco Chemical Corp.) in Isopar ®-L. Image quality was determined using a Savin 870 copier at standard mode as described in Control 1. The results on Plainwell offset enamel paper described in Control 1 are shown in Table 5 below.

EXAMPLE 7

A black toner was prepared as described in Control 8 with the following exception: 1 gram of $CrPO_4 \cdot 4H_2O$ (Alfa) was added. The uniformity of the solid areas on the offset paper was much better than that obtained with the toner prepared as described in Control 8. Results are shown in Table 5 below.

TABLE 5

| TONER | $CrPO_4.4H_2O$ (g) | COND. (pmho/mm) | PAPER | DENSITY | RES. (lp/mm) | TRANSFER EFFICIENCY |
|---|---|---|---|---|---|---|
| CONTROL 8 | NONE | 32 | OFFSET | 1.91 | 8 | 74 |
| EXAMPLE 7 | 1.0 | 34 | OFFSET | 2.20 | 9 | 75 |

CONTROL 9

An unpigmented toner is prepared by adding 25 g of a copolymer of ethylene (91%) and methacrylic acid (9%), melt index at 190° C. is 500, Acid No. is 54 and grams of Isopar®-L to a Union Process 01 Attritor, Union Process Company, Akron, Ohio charged with 0.1875 inch (4.76 mm) diameter carbon steel balls. The mixture is milled at 100° C. for 1 hour then cooled to ambient temperature and the mixture is milled for 3 hours. The toner is diluted and charged as follows: 1500 grams of 1.5% solids is charged with 11.2 grams of 10% Basic Barium Petronate®. Image quality is determined using a Savin 870 copier at standard mode as described in Control 1.

EXAMPLE 8

An unpigmented toner is prepared identically to that of Control 9 except that 0.5 gram $WCl_6$ (Aldrich, 99.9%) is added with the resin. The toner is diluted, charged and tested identically to Control 9. The toner of this Example shows improved transfer efficiency, resolution and solid area coverage when compared to the toner of Control 9.

I claim:

1. An electrostatic liquid developer having improved charging characteristics consisting essentially of (A) a nonpolar liquid having a Kauri-butanol value of less than 30, present in a major amount, (B) thermoplastic resin particles, the resin particles having an average particle size of less than 30 μm, (C) a solid inorganic metal compound, wherein the cationic component of said compound is one of the metals of Group 6B of the periodic table having an oxidation state of +3 or higher, and the anionic component of said compound is selected from the group consisting of fluoride, chloride, hydroxide, carbonate, citrate, acetate, oxalate, trifluoroacetate, sulfate, borate, nitrate, phosphate, chloride hydroxide, ethylhexanoate, potassium oxalate, potassium sulfate, and phenoxide, and (D) a nonpolar liquid soluble ionic or zwitterionic charge director compound.

2. An electrostatic liquid developer according to claim 1 wherein the cationic component of the inorganic metal compound is chromium (III).

3. An electrostatic liquid developer according to claim 1 wherein the inorganic metal compound is tungsten hexachloride.

4. An electrostatic liquid developer according to claim 2 wherein the inorganic metal compound is $CrCl_3$.

5. An electrostatic liquid developer according to claim 2 wherein the inorganic metal compound is $CrF_3$.

6. An electrostatic liquid developer according to claim 2 wherein the inorganic metal compound is $CrPO_4$.

7. An electrostatic liquid developer according to claim 1 wherein the inorganic metal compound is $MoCl_3$.

8. An electrostatic liquid developer according to claim 2 wherein the inorganic metal compound is $CrK(SO_4)_2$.

9. An electrostatic liquid developer according to claim 1 wherein component (A) is present in 85 to 99.9% by weight, based on the total weight of the liquid developer, the total weight of developer solids is 0.1 to 15.0% by weight, component (C) is present in 0.1 to 40% by weight of developer solids, and component (D) is present in an amount of 0.25 to 1500 mg/g developer solids.

10. An electrostatic liquid developer according to claim 1 containing up to about 60% by weight of a colorant based on the total weight of developer solids.

11. An electrostatic liquid developer according to claim 10 wherein the colorant is a pigment.

12. An electrostatic liquid developer according to claim 10 wherein the colorant is a dye.

13. An electrostatic liquid developer according to claim 1 wherein a fine particle size oxide is present.

14. An electrostatic liquid developer according to claim 1 wherein an additional compound is present which is an adjuvant selected from the group consisting of polyhydroxy compound, aminoalcohol, polybutylene succinimide, metallic soap, and an aromatic hydrocarbon.

15. An electrostatic liquid developer according to claim 10 wherein an additional compound is present which is an adjuvant selected from the group consisting of polyhydroxy compound, aminoalcohol, polybutylene succinimide, metallic soap, and an aromatic hydrocarbon.

16. An electrostatic liquid developer according to claim 14 wherein a polyhydroxy adjuvant compound is present.

17. An electrostatic liquid developer according to claim 14 wherein an aminoalcohol adjuvant compound is present.

18. An electrostatic liquid developer according to claim 14 wherein a polybutylene succinimide adjuvant compound is present.

19. An electrostatic liquid developer according to claim 14 wherein a metallic soap adjuvant compound is present dispersed in the thermoplastic resin.

20. An electrostatic liquid developer according to claim 14 wherein an aromatic hydrocarbon adjuvant compound having a Kauri-butanol value of greater than 30 is present.

21. An electrostatic liquid developer according to claim 17 wherein the aminoalcohol adjuvant compound is triisopropanolamine.

22. An electrostatic liquid developer according to claim 1 wherein the thermoplastic resin is a copolymer of ethylene and an α,β-ethylenically unsaturated acid selected from the group consisting of acrylic acid and methacrylic acid.

23. An electrostatic liquid developer according to claim 1 wherein the thermoplastic resin is polystyrene.

24. An electrostatic liquid developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

25. An electrostatic liquid developer according to claim 10 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

26. An electrostatic liquid developer according to claim 24 wherein the thermoplastic resin is a copolymer of ethylene (89%)/methacrylic acid (11%) having a melt index at 190° C. of 100.

27. An electrostatic liquid developer according to claim 24 wherein the thermoplastic resin is a copolymer of ethylene(91%)/methacrylic acid(9%) having a melt index at 190° C. of 500.

28. An electrostatic liquid developer according to claim 1 wherein the particles have an average particle size of less than 15 μm.

29. An electrostatic liquid developer according to claim 1 wherein component (D) is an oil-soluble petroleum sulfonate.

30. An electrostatic liquid developer according to claim 1 wherein component (D) is a sodium salt of phosphated mono- and diglycerides with unsaturated or saturated acid substituents.

31. An electrostatic liquid developer according to claim 1 wherein the inorganic metal compound is dispersed in the resin particles.

32. An electrostatic liquid developer according to claim 2 wherein the inorganic metal compound is dispersed in the resin particles.

* * * * *